US010755670B2

(12) United States Patent
Seo et al.

(10) Patent No.: US 10,755,670 B2
(45) Date of Patent: Aug. 25, 2020

(54) DISPLAY SYSTEM AND CONTROL METHOD THEREOF

(71) Applicant: Samsung Display Co., Ltd., Yongin-si (KR)

(72) Inventors: Dong Rock Seo, Yongin-si (KR); Dale Yim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 29 days.

(21) Appl. No.: 16/163,569

(22) Filed: Oct. 18, 2018

(65) Prior Publication Data

US 2019/0189079 A1 Jun. 20, 2019

(30) Foreign Application Priority Data

Dec. 18, 2017 (KR) ..... 10-2017-0174487

(51) Int. Cl.
*G09G 5/00* (2006.01)

(52) U.S. Cl.
CPC ..... *G09G 5/006* (2013.01); *G09G 2330/026* (2013.01); *G09G 2330/12* (2013.01)

(58) Field of Classification Search
CPC ..... G09G 2310/08; G09G 2230/00; G09G 2310/0264; G09G 2310/06; G09G 2320/02; G09G 2330/12; G09G 5/18; G06F 3/147
See application file for complete search history.

(56) References Cited

U.S. PATENT DOCUMENTS

| | | | | |
|---|---|---|---|---|
| 9,881,694 | B2 | 1/2018 | Busi et al. | |
| 2002/0021300 | A1* | 2/2002 | Matsushita | G09G 5/001 345/534 |
| 2007/0047347 | A1 | 3/2007 | Byun et al. | |
| 2007/0182681 | A1 | 8/2007 | Kim | |
| 2011/0012906 | A1* | 1/2011 | Kawase | G09G 3/3655 345/544 |
| 2013/0057763 | A1* | 3/2013 | Cha | G09G 5/006 348/554 |
| 2017/0162276 | A1 | 6/2017 | Ok et al. | |

* cited by examiner

*Primary Examiner* — Hau H Nguyen
(74) *Attorney, Agent, or Firm* — H.C. Park & Associates, PLC

(57) ABSTRACT

A display system including a processor configured to transmit image data and command data, the command data including a first command corresponding to storing the image data and a second command corresponding to outputting the image data, and a display driving circuit configured to receive the image data and the command data from the processor and to process the image data according to the command. The display driving circuit generates a garbage image generation signal by comparing receiving timings of the first command and the second command.

15 Claims, 4 Drawing Sheets

DISPLAY SYSTEM AND CONTROL METHOD THEREOF

CROSS-REFERENCE TO RELATED APPLICATION

This application claims priority from and the benefit of Korean Patent Application No. 10-2017-0174487, filed on Dec. 18, 2017, which is hereby incorporated by reference for all purposes as if fully set forth herein.

BACKGROUND

Field

Exemplary embodiments of the invention relate to a display system and a control method thereof.

Discussion of the Background

A display system mounted on a mobile device or the like includes an application processor (hereinafter referred to as a "processor") and a display driver circuit. As the display resolution increases, the required amount of image data to be transmitted between the processor and the display driving circuit rapidly increases.

However, during the initial driving period which occurs immediately after the display is powered-on, latency may increase in processing the image data by the processor. Accordingly, a delay may occur when processing the image data in the display driving circuit, and a display panel may display a "garbage" image, which is abnormal data.

The above information disclosed in this Background section is only for understanding of the background of the inventive concepts, and, therefore, it may contain information that does not constitute prior art.

SUMMARY

Exemplary embodiments of the inventive concepts are directed to a display system capable of easily determining whether a garbage image is generated or not, and a control method thereof.

Additional features of the inventive concepts will be set forth in the description which follows, and in part will be apparent from the description, or may be learned by practice of the inventive concepts.

An exemplary embodiment provides a display system including a processor configured to transmit image data and command data, the command data including a first command corresponding storing the image data and a second command corresponding to outputting the image data, and a display driving circuit configured to receive the image data and the command data from the processor and to process the image data according to the command data. The display driving circuit generates a garbage image generation signal by comparing receiving timings of the first command and the second command.

The display driving circuit may include a memory configured to store the image data, a command determining unit configured to determine receiving timings of the first command and the second command, and a garbage image monitoring unit configured to output the garbage image generation signal when the receiving timing of the second command is earlier than the receiving timing of the first command.

The command determining unit may be configured to output a first flag signal corresponding to the receiving timing of the first command, and output a second flag signal corresponding to the receiving timing of the second command.

The garbage image monitoring unit may be configured to output the garbage image generation signal when the first flag signal is a low value and the second flag signal is a high value.

The display system may further include a display panel configured to display an image corresponding to the image data.

The display driving circuit may further include a test mode unit configured to output a predetermined image pattern to the display panel in response to control of the garbage image monitoring unit The garbage image monitoring unit may be configured to output a test mode enable signal to the test mode unit when the receiving timing of the second command is earlier than the receiving timing of the first command.

According to a predetermined display power-on sequence, the first command is transmitted in each frame and the second command is transmitted once.

Codes and functions of the command data are defined by mobile industry processor interface (MIPI).

The display driving circuit consists of an integrated circuit (IC).

Another exemplary embodiment provides a control method of a display system including transmitting, by a processor, image data and command data, the command data including a first command corresponding to storing the image data and a second command corresponding to outputting the image data; receiving, by a display driving circuit, the image data and the command data from the processor and to process the image data according to the command data; and generating, by the display driving circuit, a garbage image generation signal by comparing receiving timings of the first command and the second command.

The generating of the garbage image generation signal may include determining the receiving timings of the first command and the second command, and outputting the garbage image generation signal when the receiving timing of the second command is earlier than the receiving timing of the first command.

The determining of the receiving timings of the first command and the second command may include outputting a first flag signal corresponding to the receiving timing of the first command, and outputting a second flag signal corresponding to the receiving timing of the second command.

The outputting of the garbage image generation signal may include outputting the garbage image generation signal when the first flag signal is a low value and the second flag signal is a high value.

The control method may further include outputting a predetermined image pattern a display panel when the receiving timing of the second command is earlier than the receiving timing of the first command.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
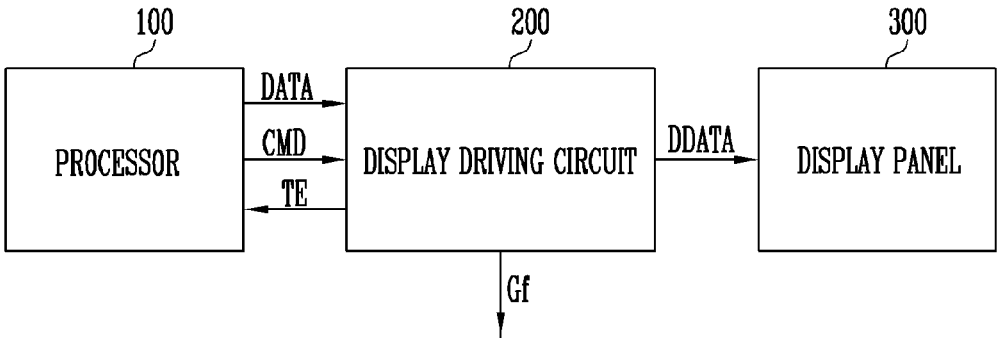
FIG. 1 is a block diagram schematically illustrating a display system according to an exemplary embodiment.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and is the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CD-RW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments of the invention will be described in more detail with reference to the accompanying drawings.

FIG. 1 is a block diagram schematically illustrating a display system according to an exemplary embodiment.

The display system may include at least one of a smart phone, a tablet computer, a personal digital assistant (PDA), a portable multimedia player (PMP), a digital camera, a music player, a portable game console, a navigation system, a personal computer (PC), a laptop computer, a server computer, a workstation, a digital TV Television.

Referring to FIG. 1, the display system according to an exemplary embodiment includes a processor 100, a display driving circuit 200, and a display panel 300.

The processor 100 transmits image data DATA and command data CMD for processing the image data DATA to the display driving circuit 200. In an exemplary embodiment, the processor 100 may be a graphics card of a computer system or an application processor of a mobile device.

The processor 100 and the display drive circuit 200 may transmit and receive the image data DATA and the command data CMD in accordance with the preset communication interface protocol. Codes and functions of the command data CMD may be defined by mobile industry processor interface (MIPI).

In an exemplary embodiment, according to the MIPI specification, the command data CMD includes a 2Ch command (hereinafter referred to as a "first command") for instructing to store the image data DATA in the display drive circuit 200, and a 29h command (hereinafter referred to as a "second command") for instructing to output the image data (DATA). The second command is a command for instructing display-on of the image data DATA.

In addition, the processor 100 receives a tearing effect signal TE from the display driving circuit 200. The processor 100 may control the transmission timing of the image data DATA according to the received tearing effect signal TE.

The display driving circuit 200 receives the image data DATA and the command data CMD from the processor 100 and processes the image data DATA in accordance with the received command data CMD. The display driving circuit 200 may convert the received image data DATA into output image data DDATA suitable for being displayed by the display panel 300 and output the output image data DDATA to the display panel 300.

The display driving circuit 200 may normally drive the display panel 300 when the command data CMD is sequentially received according to a predetermined communication interface protocol.

For example, in accordance with the display power-on sequence predetermined by the MIPI protocol, the first command may be set to be transmitted for each frame and the second command may be set to be transmitted once after power-on. The display driving circuit 200 stores the image data DATA in a predetermined memory when the first command is input, and outputs the stored image data DATA as the output image data DDATA to the display panel 300. Therefore, the display driving circuit 200 may output normal image data when the first command is received before the second command.

However, when a transmission delay occurs in the processor 100 during the initial driving after the display is powered-on, the first command and the image data DATA may be transmitted later than the second command. Accordingly, processing the image data DATA is delayed in the display driving circuit 200, and abnormal data may be output to the display panel 300. The abnormal data may be defined as a "garbage image". Since the garbage image is output for a short time and then normalized, it is not easy to visually check whether the display is abnormal.

The display driving circuit 200 monitors whether or not the command data CMD has been normally received and outputs the monitoring result. Based on the monitoring result, an inspector may easily check whether or not the garbage image is generated.

In an exemplary embodiment, the display driving circuit 200 compares receiving timings of the first command and the second command, and generates a garbage image generation signal Gf when the receiving timing of the second command is earlier than the receiving timing of the first command. The garbage image generation signal Gf may be output through an output terminal (not shown) or a monitoring terminal (not shown) provided in the display driving circuit 200. The inspector can easily check whether the garbage image is generated by detecting the output of the garbage image generation signal Gf using a signal detecting device (not shown).

Although not shown in detail, the display driving circuit 200 may include an integrated circuit (IC) integrated with a timing controller, a data driver, and a scan driver for driving the display panel 300. A detailed description of the display driving circuit 200 is given below.

The display panel 300 displays an image corresponding to the image data DATA. The display driving circuit 200 outputs the output image data DDATA based on the image data DATA from the processor 100, and the display panel 300 displays the image corresponding to the output image data DDATA from the display driving circuit 200.

For example, the display panel 300 may be a liquid crystal display (LCD) panel or an organic light emitting display (OLED) panel.

In FIG. 1, the display driving circuit 200 and the display panel 300 are illustrated as separate components in order to more clearly explain the elements of the present invention, but the inventive concepts are not limited thereto. That is, the display driving circuit 200 and the display panel 300 may be combined with each other, or may be integrated into one panel.

Figure 2:
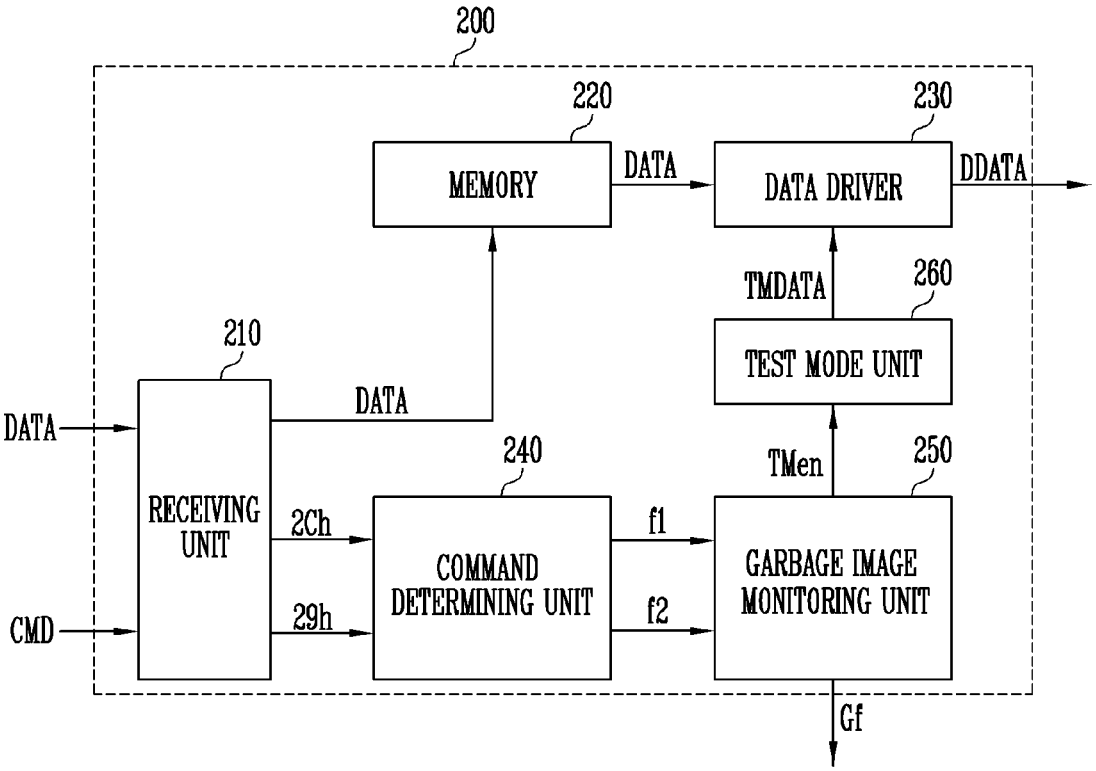
FIG. 2 is a view illustrating a display driving circuit according to an exemplary embodiment.

FIG. 2 is a view illustrating the display driving circuit 200 according to an exemplary embodiment.

Referring to FIG. 2, the display driving circuit 200 includes a receiving unit 210, a memory 220, a data driver 230, a command determining unit 240, a garbage image monitoring unit 250, and a test mode unit 260.

The receiving unit 210 receives the image data DATA and the command data CMD from the processor 100. The receiving unit 210 provides the image data DATA to the memory 220.

The receiving unit 210 provides a specific command from the command data CMD to the command determining unit 240. The receiving unit 210 provides the first command 2Ch and the second command 29h to the command determining unit 240. The first command 2Ch instructs to write the received image data DATA to the memory 220, and the second command 29h instructs to output the image data DATA stored in the memory 220.

The memory 220 stores the image data DATA provided from the receiving unit 210. In an example, the memory 220 may store the image data DATA corresponding to one frame and provide the stored image data DATA to the data driver 230.

For example, the memory 220 may be a volatile memory (e.g., dynamic RAM, SRAM, synchronous dynamic RAM (SDRAM), etc.) or a non-volatile memory (e.g., programmable ROM (PROM), erasable and programmable ROM (EPROM), electrically erasable and programmable ROM (EEPROM), mask ROM, flash ROM, NAND flash memory, NOR flash memory).

The data driver 230 converts the output image data DDATA from the image data DATA provided from the memory 220 and outputs the output image data (DDATA). The data driver 230 outputs the output image data DDATA to the display panel 300 in response to a control signal provided from the timing controller (not shown) in the display driving circuit 200.

The command determining unit 240 determines the receiving timing of the first command 2Ch and the receiving timing of the second command 29h provided from the receiving unit 210. The command determining unit 240 outputs a first flag signal f1 corresponding to the first command 2Ch and a second flag signal f2 corresponding to the second command 29h to the garbage image monitoring unit 250.

When receiving the first command 2Ch, the command determining unit 240 outputs the first flag signal f1 having a high value. In addition, when receiving the first command 29h, the command determining unit 240 outputs the second flag signal f2 having a high value. The high value may be a logical "one" value or a voltage level indicating whether the command is received or not.

The garbage image monitoring unit 250 generates and outputs the garbage image generation signal Gf when the second command 29h is received earlier than the first command 2Ch. The garbage image monitoring unit 250 determines the receiving timings of the first command 2Ch and the second command 29h based on the first flag signal f1 and the second flag signal f2. When the receiving timing of the second command is earlier than the receiving timing of the first command, the garbage image monitoring unit 250 determines that the garbage image has been generated and outputs the garbage image generation signal Gf.

For example, when neither the first command 2Ch nor the second command 29h is received, the first flag signal f1 and the second flag signal f2 are low values. When the first command 2Ch is received and the second command 29h is not received, the first flag signal f1 is a high value and the second flag signal f2 is a low value. When the first command 2Ch is not received and the second command 29h is received, the first flag signal f1 is a low value and the second flag signal f2 is a high value. When both the first command 2Ch and the second command 29h are received, the first flag signal f1 and the second flag signal f2 are high values.

When the first flag signal f1 is a low value and the second flag signal f2 is a high value, the garbage image monitoring unit 250 outputs the garbage image generation signal Gf having a high value. The garbage image generation signal Gf may be set to predetermined voltage level.

In addition, when the first flag signal f1 is a low value and the second flag signal f2 is a high value, the garbage image monitoring unit 250 outputs a test mode enable signal TMen to the test mode unit 260. The garbage image monitoring unit 250 may output the test mode enable signal TMen together with the garbage image generation signal Gf having the high value.

The test mode module 260 outputs a predetermined image pattern TMDATA to the data driver 230 when the test mode enable signal TMen is provided from the garbage image monitoring module 250. Then, the data driver 230 stops the output of the output image data DDATA corresponding to the image data DATA and outputs the output image data DDATA corresponding to the predetermined image pattern TMDATA.

Thereby, the inspector may easily visually check whether or not the garbage image of the display system is generated.

Figure 3A:
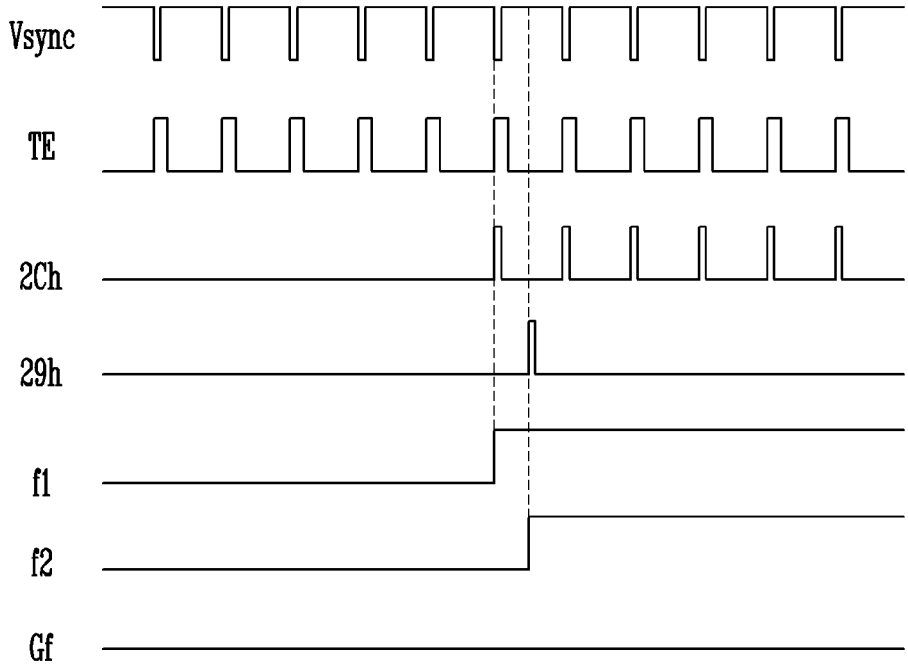
FIG. 3A is a waveform diagram illustrating a garbage image generation signal in a normal state.
Figure 3B:
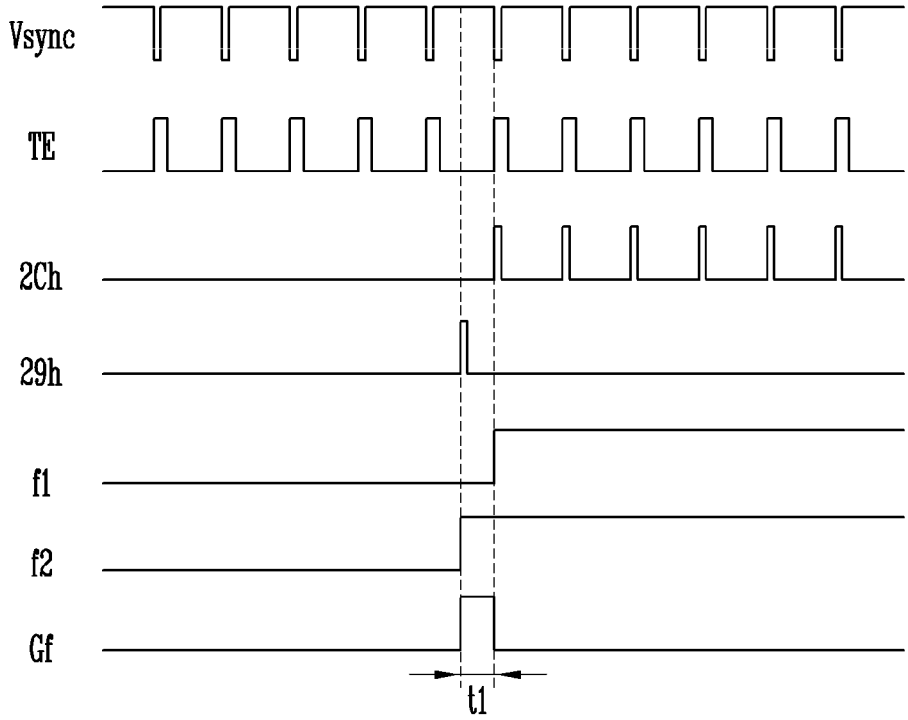
FIG. 3B and FIG. 3C are waveform diagrams illustrating a garbage image generation signal in an abnormal state.
Figure 3C:
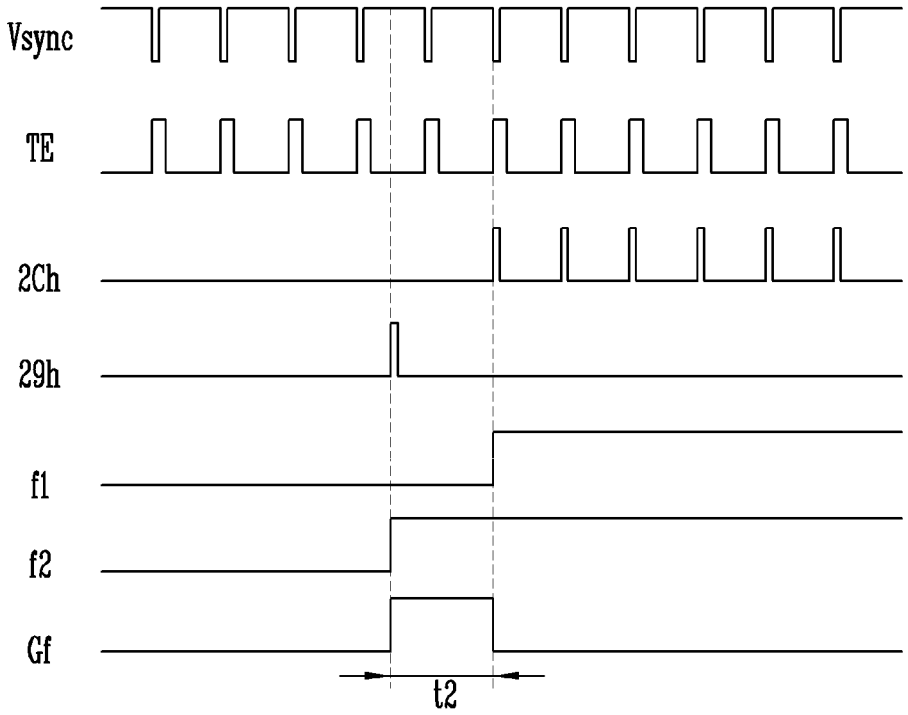

FIG. 3A is a waveform diagram illustrating a garbage image generation signal in a normal state. FIGS. 3B and 3C are waveform diagrams illustrating a garbage image generation signal in an abnormal state.

Referring to FIG. 3A, a vertical synchronization signal Vsync generated in the processor 100 and the tearing effect signal TE generated in the display driving circuit 200 are synchronized and have a period of one frame.

The first command 2Ch is transmitted frame-by-frame with the image data DATA. The first command 2Ch is synchronized with the vertical synchronization signal Vsync.

The second command 29h may be transmitted once after power-on. The second command 29h is transmitted only once during the initial driving after the display is powered-on.

The first flag signal f1 corresponding to the first command 2Ch has a high value from the time when the first command 2Ch is received. The second flag signal f2 corresponding to the second command 29h has a high value from the time when the second command 29h is received.

The garbage image generation signal Gf is generated based on the first flag signal f1 and the second flag signal f2. The garbage image generation signal Gf is output when the first flag signal f1 has the low value and the second flag signal f2 has the high value.

In the normal state in which the garbage image is not generated, the second command 29h is received after the first command 2Ch is received. In this normal state, the case in which the first flag signal f1 has the low value and the second flag signal f2 has the high value is not generated. Therefore, the garbage image generation signal Gf is not output.

Referring to FIGS. 3B and 3C, in the abnormal state where garbage is generated, the first command 2Ch is received after the second command 29h is received. In this abnormal state, the first flag signal f1 has the low value and the second flag signal f2 has the high value.

The garbage image generation signal Gf is output when the first flag signal f1 has the low value and the second flag signal f2 has the high value. The garbage image generation signal Gf is output until the first command 2Ch is received after the second command 29h is received. The garbage image generation signal Gf may be set to a predetermined voltage level.

Periods t1 and t2 during which the garbage image generation signal Gf is output may be proportional to the time delay of receiving of the first command 2Ch. As shown in FIG. 3B, when the first command 2Ch is delayed by the first period t1, the garbage image generation signal Gf is output during the first period t1. As shown in FIG. 3C, when the first command 2Ch is delayed by the second period t2, the garbage image generation signal Gf is output during the second period t2.

Figure 4:
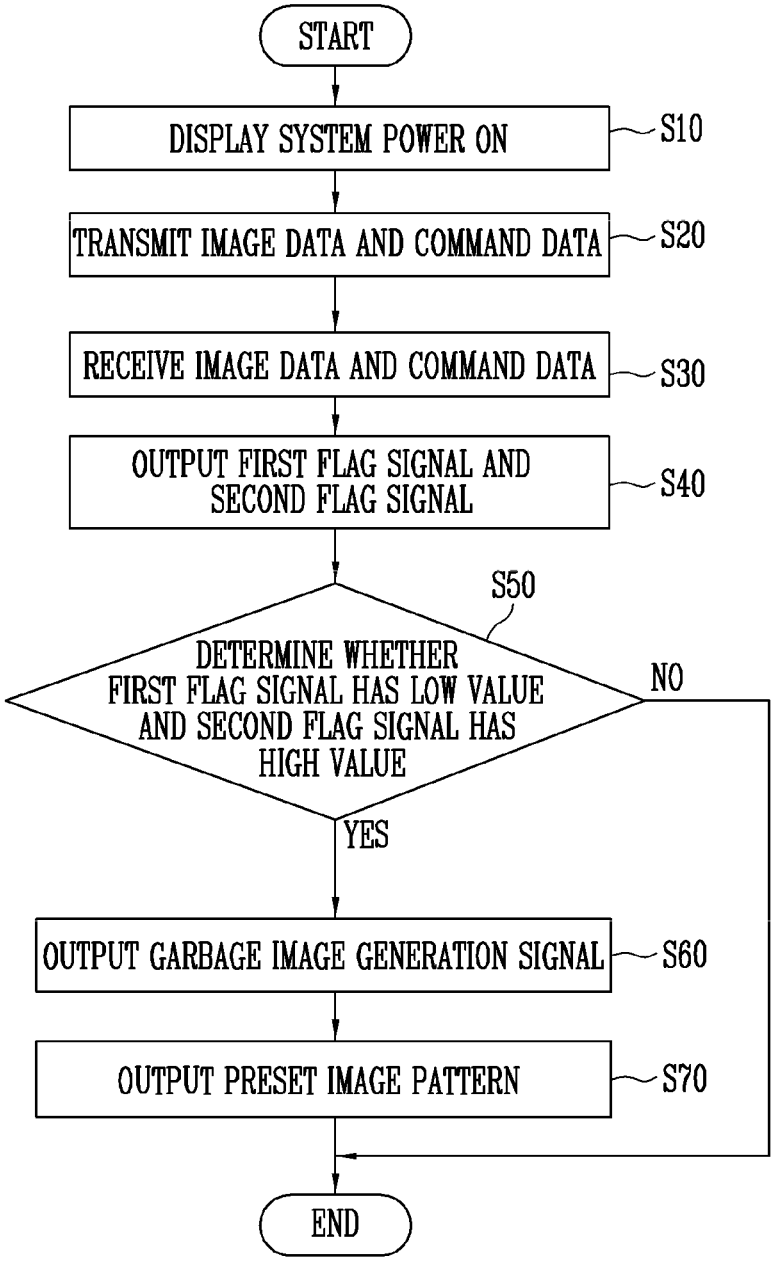
FIG. 4 is a flowchart illustrating a control method of a display system according to an exemplary embodiment.

FIG. 4 is a flowchart illustrating a control method of a display system according to an exemplary embodiment.

Referring to FIG. 4, the control method of the display system, first, the display system is powered on (S10).

The processor 100 transmits the image data DATA and the command data CMD for processing the image data DATA to the display driving circuit 200 (S20). The processor 100 and the display drive circuit 200 transmit and receive the image data DATA and the command data CMD in accordance with the preset communication interface protocol. Codes and functions the command data CMD are defined codes and by mobile industry processor interface (MIPI).

In an exemplary embodiment, according to the MIPI specification, the command data CMD includes a 2Ch command (hereinafter referred to as a first command) for instructing to store the image data DATA in the display drive circuit 200, and a 29h command (hereinafter referred to as a second command) for instructing to output the image data DATA. The second command is a command for instructing display-on of the image data DATA.

The display driving circuit 200 receives the image data DATA and the command data CMD from the processor 100 (S30). The display driving circuit 200 includes the receiving unit 210, the memory 220, the data driver 230, the command determining unit 240, the garbage image monitoring unit 250, and the test mode unit 260. The receiving unit 210 receives the image data DATA and the command data CMD from the processor 100. The receiving unit 210 provides the image data DATA to the memory 220.

The receiving unit 210 provides a specific command from the command data CMD to the command determining unit 240. The receiving unit 210 provides the first command 2Ch and the second command 29h to the command determining unit 240.

Next, the command determining unit 240 outputs the first flag signal f1 corresponding to the first command 2Ch and the second flag signal f2 corresponding to the second command 29h to the garbage image monitoring unit 250 (S40).

When receiving the first command 2Ch, the command determining unit 240 outputs the first flag signal f1 having a high value. In addition, when receiving the first command 29h, the command determining unit 240 outputs the second flag signal f2 having a high value. The high value may be a logical value or a voltage level which indicates whether the command is received or not. However, the first and second flag signals f1 and f2 may be set to have low values.

Next, the garbage image monitoring unit 250 determines whether the first flag signal f1 has the low value and the second flag signal f2 has the high value (S50). The garbage image monitoring unit 250 determines the receiving timings of the first command 2Ch and the second command 29h based on the first flag signal f1 and the second flag signal f2

In step S50, if the first flag signal f1 has the low value and the second flag signal f2 has the high value, the garbage image monitoring unit 250 outputs the garbage image generation signal Gf (S60). When the receiving timing of the second command is earlier than the receiving timing of the first command, the garbage image monitoring unit 250 determines that the garbage image has been generated and output the garbage image generation signal Gf. The garbage image generation signal Gf may be set to a predetermined voltage level.

On the other hand, when neither the first command 2Ch nor the second command 29h is received, the first flag signal f1 and the second flag signal f2 are low values. When the first command 2Ch is received and the second command 29h is not received, the first flag signal f1 is a high value and the second flag signal f2 is a low value. When both the first command 2Ch and the second command 29h are received, the first flag signal f1 and the second flag signal f2 are high values. In the above cases, the garbage image monitoring unit 250 does not output the garbage image generation signal Gf.

Next, the display system is set to output a preset image pattern to the display panel 300 (S70). When the first flag signal f1 is a low value and the second flag signal f2 is a high value, the garbage image monitoring unit 250 outputs the test mode enable signal TMen to the test mode unit 260. The test mode module 260 outputs the predetermined image pattern TMDATA to the data driver 230 when the test mode enable signal TMen is provided from the garbage image monitoring module 250.

According to the inventive concepts, it is possible to easily check whether a garbage image is generated in the display system by using the garbage image generation signal Gf output from the garbage image monitoring unit 250.

In addition, it is possible to check the latency period of the processor 100 by checking the period during which the garbage image generation signal Gf is output. Also, the timing of the processor 100 may be set appropriately using the latency period so that garbage is not generated.

According to the present disclosure, receiving timings of a first command corresponding to storing image data and a second command corresponding to outputting pre-stored image data are compared, a garbage image generation signal is generated when the receiving timing of the second command is earlier than the receiving timing of the first command, so that it may be easily checked whether a garbage image is generated.

In addition, a latency period of a processor may be checked based on the garbage image generation signal, and timing of the processor may be appropriately using the checked latency period so as not to generate a garbage image.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display system comprising:

a processor configured to transmit image data and command data, the command data including a first command corresponding to storing the image data and a second command corresponding to outputting the image data; and a display driving circuit configured to receive the image data and the command data from the processor and to process the image data according to the command data, wherein:

the display driving circuit is configured to generate a first flag signal corresponding to the first command and a second flag signal corresponding to the second command;

the display driving circuit is configured to generate a garbage image generation signal based on a logic value of the first flag signal and a logic value of the second flag signal;

the garbage image generation signal is generated when the first flag signal is a low value and the second flag signal is a high value; and a period during which the garbage image generation signal is maintained is from a point of time when the second flag signal is changed from the low value to the high value to a point of time when the first flag signal is changed from the low value to the high value after the second flag signal is changed.

2. The display system of claim 1, wherein the display driving circuit comprises:

a memory configured to store the image data;

a command determining unit configured to determine receiving timings of the first command and the second command; and a garbage image monitoring unit configured to output the garbage image generation signal when the receiving timing of the second command is earlier than the receiving timing of the first command.

3. The display system of claim 2, wherein the command determining unit is configured to output the first flag signal corresponding to the receiving timing of the first command, and output the second flag signal corresponding to the receiving timing of the second command.

4. The display system of claim 3, wherein the garbage image monitoring unit is configured to output the garbage image generation signal when the first flag signal is the low value and the second flag signal is the high value.

5. The display system of claim 1, further comprising a display panel configured to display an image corresponding to the image data.

6. The display system of claim 5, wherein the display driving circuit further comprises a test mode unit configured to output a predetermined image pattern to the display panel in response to control of the garbage image monitoring unit.

7. The display system of claim 6, wherein the garbage image monitoring unit is configured to output a test mode enable signal to the test mode unit when the receiving timing of the second command is earlier than the receiving timing of the first command.

8. The display system of claim 1, wherein according to a predetermined display power-on sequence, the first command is transmitted in each frame and the second command is transmitted once.

9. The display system of claim 1, wherein codes and functions of the command data are defined by mobile industry processor interface (MIPI).

10. The display system of claim 1, wherein the display driving circuit consists of an integrated circuit (IC).

11. A control method of a display system, the method comprising:

transmitting, by a processor, image data and command data, the command data including a first command corresponding to storing the image data and a second command corresponding to outputting the image data;

receiving, by a display driving circuit, the image data and the command data from the processor and to process the image data according to the command data;

generating, by the display driving circuit, a first flag signal corresponding to the first command and a second flag signal corresponding to the second command; and generating, by the display driving circuit, a garbage image generation signal based on a logic value of the first flag signal and a logic value of the second flag signal, wherein:

the garbage image generation signal is generated when the first flag signal is a low value and the second flag signal is a high value; and a period during which the garbage image generation signal is maintained is from a point of time when the second flag signal is changed from the low value to the high value to a point of time when the first flag signal is changed from the low value to the high value after the second flag signal is changed.

12. The control method of claim 11, wherein the generating of the garbage image generation signal comprises:

determining receiving timings of the first command and the second command; and outputting the garbage image generation signal when the receiving timing of the second command is earlier than the receiving timing of the first command.

13. The control method of claim 12, wherein the determining of the receiving timings of the first command and the second command comprises outputting the first flag signal corresponding to the receiving timing of the first command, and outputting the second flag signal corresponding to the receiving timing of the second command.

14. The control method of claim 13, wherein the outputting of the garbage image generation signal comprises outputting the garbage image generation signal when the first flag signal is the low value and the second flag signal is the high value.

15. The control method of claim 11, further comprising outputting a predetermined image pattern to a display panel when the receiving timing of the second command is earlier than the receiving timing of the first command.

* * * * *